US009915135B1

(12) United States Patent
Malone

(10) Patent No.: US 9,915,135 B1
(45) Date of Patent: Mar. 13, 2018

(54) DOWNHOLE POWERED DEVICE SYSTEM

(71) Applicant: ACCESSESP UK LIMITED, Houston, TX (US)

(72) Inventor: David Malone, Houston, TX (US)

(73) Assignee: ACCESSESP UK LIMITED (GB)

( * ) Notice: Subject to any disclaimer, the term of this patent is extended or adjusted under 35 U.S.C. 154(b) by 238 days.

(21) Appl. No.: 14/627,732

(22) Filed: Feb. 20, 2015

Related U.S. Application Data

(60) Provisional application No. 61/943,549, filed on Feb. 24, 2014.

(51) Int. Cl.

| | |
|---|---|
| ***E21B 43/12*** | (2006.01) |
| ***E21B 47/017*** | (2012.01) |
| ***E21B 47/00*** | (2012.01) |
| ***E21B 47/01*** | (2012.01) |
| ***E21B 47/06*** | (2012.01) |
| ***F04B 47/00*** | (2006.01) |

(52) U.S. Cl.
CPC ..... *E21B 43/128* (2013.01); *E21B 47/0007* (2013.01); *E21B 47/011* (2013.01); *E21B 47/06* (2013.01); *E21B 47/065* (2013.01); *F04B 47/00* (2013.01)

(58) Field of Classification Search
CPC .... E21B 43/128; E21B 47/0007; E21B 47/06; E21B 47/065; E21B 47/011; F04B 47/00
See application file for complete search history.

(56) References Cited

U.S. PATENT DOCUMENTS

| | | | | |
|---|---|---|---|---|
| 2003/0127223 | A1* | 7/2003 | Branstetter | E21B 47/10 166/250.15 |
| 2004/0149443 | A1* | 8/2004 | La Rovere | E21B 33/14 166/302 |
| 2012/0121224 | A1* | 5/2012 | Dalrymple | E21B 17/023 385/101 |

* cited by examiner

*Primary Examiner* — Brad Harcourt
(74) *Attorney, Agent, or Firm* — Gordon G. Waggett, P.C.

(57) ABSTRACT

System and method for providing power to a downhole powered device through a sensor housing. At least some of the illustrative embodiments are a powered device engaged with a power line connectable to a power supply by a power connector, and a sensor system arranged in a sensor housing, the sensor housing located between the powered device and the power connector, and the power line passing through the sensor housing such that heat generated from the power line is dissipated away from the sensor system.

30 Claims, 7 Drawing Sheets

DOWNHOLE POWERED DEVICE SYSTEM

CROSS-REFERENCE TO RELATED APPLICATIONS

The present application claims the benefit of, and incorporates by reference, U.S. Provisional Application No. 61/943,549, filed Feb. 24, 2014, and entitled "Downhole Powered Device System."

FIELD OF THE INVENTION

This invention relates generally to a downhole powered device system such as an electric submersible pump (ESP) in a downhole well environment and methods and apparatus for avoiding thermal interference with other devices and failure due to overheating.

BACKGROUND

Electric submersible pump (ESP) systems are typically installed in oil and gas wells where reservoir pressure is inadequate to lift reservoir fluids to the surface or to increase production in natural producing wells. As a reservoir is produced, the pressure in the pore space of the rocks decreases, and thus may require the introduction of some type of artificial lift system to continue production as a reservoir or a well ages. An ESP system provides an artificial lift for a reservoir and/or well and comprises a motor to convert electrical power from a cable to mechanical power to drive the pump.

While operating the powered devices associated with an ESP system in a downhole environment, it is important to make accurate and real time measurements of operational properties associated with the downhole device and its surroundings. Accurate monitoring of these operating parameters can help ensure reliable operation and can allow for the detection of problems with the system from the surface. When operating an electric submersible pump it can be beneficial to monitor properties associated with the fluid surrounding the pump and also the temperature and vibrations within the ESP system. In most operating environments, it can be critical to monitor the temperature of the ESP motor, because overheating of the motor can greatly affect the performance and durability of the device and can cause damage to vital electrical circuits and sensors.

Referring now to FIG. 1, a prior art ESP system is shown comprising pump 16 and motor 8, which drives pump 16. Power from a power line located externally of production tube 17 is connected to motor 8 by way of wet connect 15. Sealing means 18 are provided between the pump and the production tube 17 so the flow path of produced fluids is into the pump inlet 20 and out through the pump outlet beyond the sealing means 18 and upwardly toward the surface. An electronic sensor system (ESP gauge) 2 is typically provided with an ESP system and includes sensors configured to measure and monitor the fluid properties in the well in addition to the operating properties of the motor. By monitoring characteristics of the motor such as the operating temperature, pressure and vibration, the operation of the motor can be controlled to prevent overheating, failure or operating conditions that would shorten its life. In the typical configuration, the gauge is connected to the motor by way of capillary tubes (not shown) that house the electrical connecting leads for transmitting the sensed information pertaining to temperature, pressure, vibration, or other operating parameters of the motor. These capillary tubes are typically routed along the wet connect portion of the tubing string and are housed within grooves in the ESP system housing to protect the tubes and connecting leads from damage during deployment and use. With the gauge 2 located downhole from the motor 8 as shown in this arrangement, the capillary tubes and cabling must pass around the wet connect module 15 in order to connect the ESP motor with the sensor device. Accordingly, the location and configuration of these capillary tubes and cabling make the manufacture, deployment and maintenance of the sensor system difficult and are a significant source of damage, failure or malfunction.

Additionally, the location of the gauge at a position spaced away from the motor may introduce unreliability and error into the task of obtaining, monitoring, or processing sensor information that is indicative of motor performance and wellbore conditions. Therefore, any advance that could provide for a more reliable and protected manner of connection for the ESP system sensor equipment located within the gauge would provide a competitive advantage.

BRIEF SUMMARY

This invention relates to a downhole powered device system including a sensor system and comprising: a powered device, a power line connectable to a power supply by a power connector, the sensor system arranged in a sensor housing, whereby the sensor housing is located between the powered device and the power connector, and the power line passes through the sensor housing to the powered device.

According to a further aspect of the invention, a power line support apparatus is provided for use with a downhole powered device including an electrical power line comprising: a heat dissipating tray and a sensor housing wall, with the power line is located between the heat dissipating tray and the sensor housing wall, wherein the heat dissipating tray is urged toward the internal surface of the housing wall to provide direct contact between the power line and the internal surface, to transfer heat from the power line to the external surface of the sensor housing wall.

The ESP motor is traditionally connected directly to the power cable 17 or power supply module 15 because pumping applications require large currents which must pass through the power lines to power the ESP system. These power lines can generate significant heat and electrical noise which is a problem exacerbated by the compact design of the down hole equipment. Due to the close proximity of the ESP gauge sensor leads to the motor, the noise generated by the power lines can affect the readings measured by the sensors. In addition the heat generated by the cables can negatively impact the reliability of the gauge electronics.

According to a further aspect of the embodiments described herein, the heat generated by the power line and other electrical components connected in the vicinity of the motor is readily conducted away from the area adjacent to the sensitive sensory equipment and out into the well fluids passing on the surrounding environment. In the case of an ESP system the outer surface of the ESP sensor housing is in contact with flowing fluid being pumped by the ESP system. This creates a constant thermal gradient and maintains high transfer of heat away from the ESP sensor housing. This transfer of heat prevents the heat dissipating throughout the downhole system, and improves the life and reliability of the gauge electronics and sensors in the ESP gauge.

Thus it can be seen that the arrangement of the embodiments described herein eliminates the need for the sensors leads to pass from the sensor to the motor power connection module. Similarly, the current embodiments make possible for configurations where the protective capillary tubes and the locating grooves for sensors in the area of the wet connect are not required. These improvements lead to both lower assembly costs, more repeatable manners of deployment, and also a greater reliability of the sensor system during downhole use.

BRIEF DESCRIPTION OF THE DRAWINGS

For a detailed description of exemplary embodiments, reference will now be made to the accompanying drawings in which.

NOTATION AND NOMENCLATURE

Figure 1:
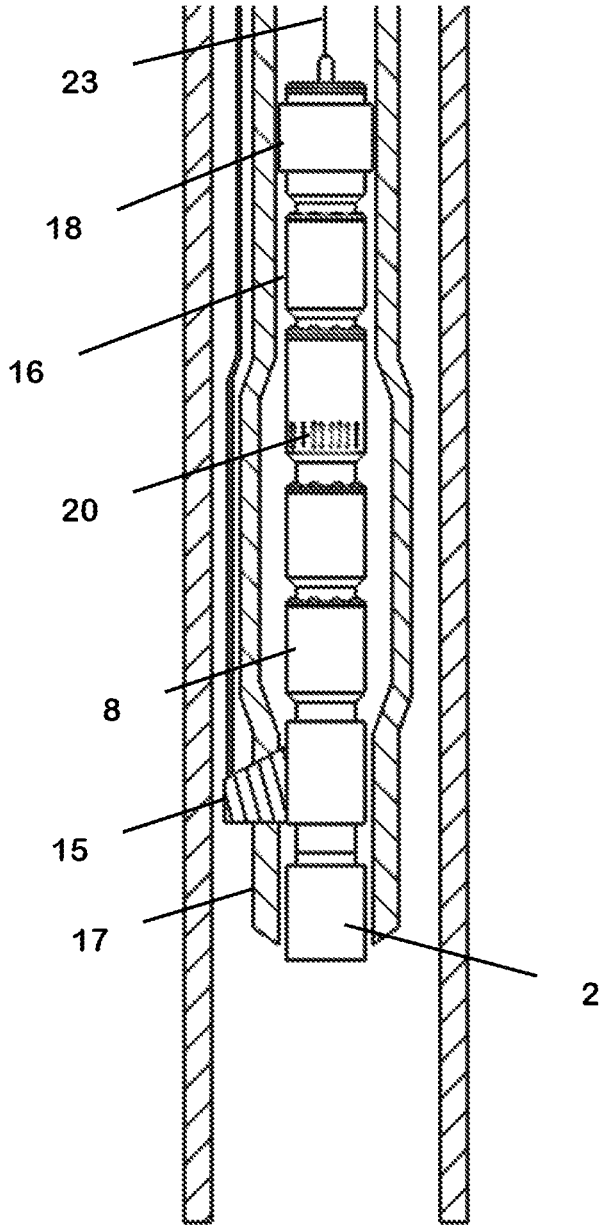
FIG. 1 shows a longitudinal section view of a prior art arrangement for powering a motor and a pump within a well in accordance with at least some embodiments.

Certain terms are used throughout the following description and claims to refer to particular system components. As one skilled in the art will appreciate, companies that design and manufacture downhole oil and gas systems may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect electrical connection via other devices and connections.

Reference to a singular item includes the possibility that there are plural of the same items present. More specifically, as used herein and in the appended claims, the singular forms "a," "an," "said" and "the" include plural references unless the context clearly dictates otherwise. It is further noted that the claims may be drafted to exclude any optional element. As such, this statement serves as antecedent basis for use of such exclusive terminology as "solely," "only" and the like in connection with the recitation of claim elements, or use of a "negative" limitation. Lastly, it is to be appreciated that unless defined otherwise, all technical and scientific terms used herein have the same meaning as commonly understood by one of ordinary skill in the art to which this invention belongs.

Where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

DETAILED DESCRIPTION

Before the various embodiments are described in detail, it is to be understood that this invention is not limited to particular variations set forth herein as various changes or modifications may be made, and equivalents may be substituted, without departing from the spirit and scope of the invention. As will be apparent to those of skill in the art upon reading this disclosure, each of the individual embodiments described and illustrated herein has discrete components and features which may be readily separated from or combined with the features of any of the other several embodiments without departing from the scope or spirit of the present invention. In addition, many modifications may be made to adapt a particular situation, material, composition of matter, process, process act(s) or step(s) to the objective(s), spirit or scope of the present invention. All such modifications are intended to be within the scope of the claims made herein.

Figure 2:
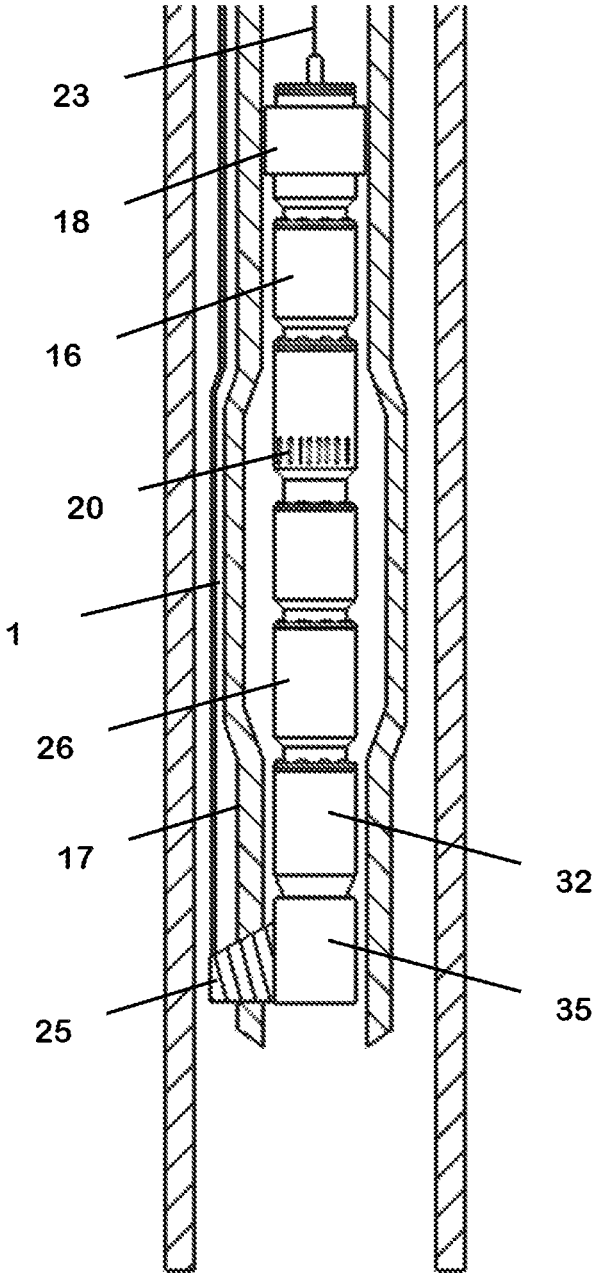
FIG. 2 shows a longitudinal section view of a well and an embodiment of a downhole pump system in accordance with at least some embodiments.

Referring to FIG. 2, an electric submersible pump (ESP) system is characterized by pump modules 16 disposed adjacent to ESP motor modules 26 and a sensor housing 32 (also referred to as ESP gauge 32) disposed below the motor 26. The pumps 16 and the motors 26 are connected in series, and as configured in the illustrated embodiment the pumps 16 may be situated upstream of the motors 26. For the purpose of ease of reference to the figures the relative positions may be referred to as above or below, showing the relation as shown in figures whereas in reality the well may well be horizontal so reference to upstream and downstream is also used. Referring to FIG. 2, the lowermost pump 16 includes a pump inlet 20 (or ESP housing inlet 20). A pump outlet (not shown) is disposed above an engageable seal 18.

Figure 2A:
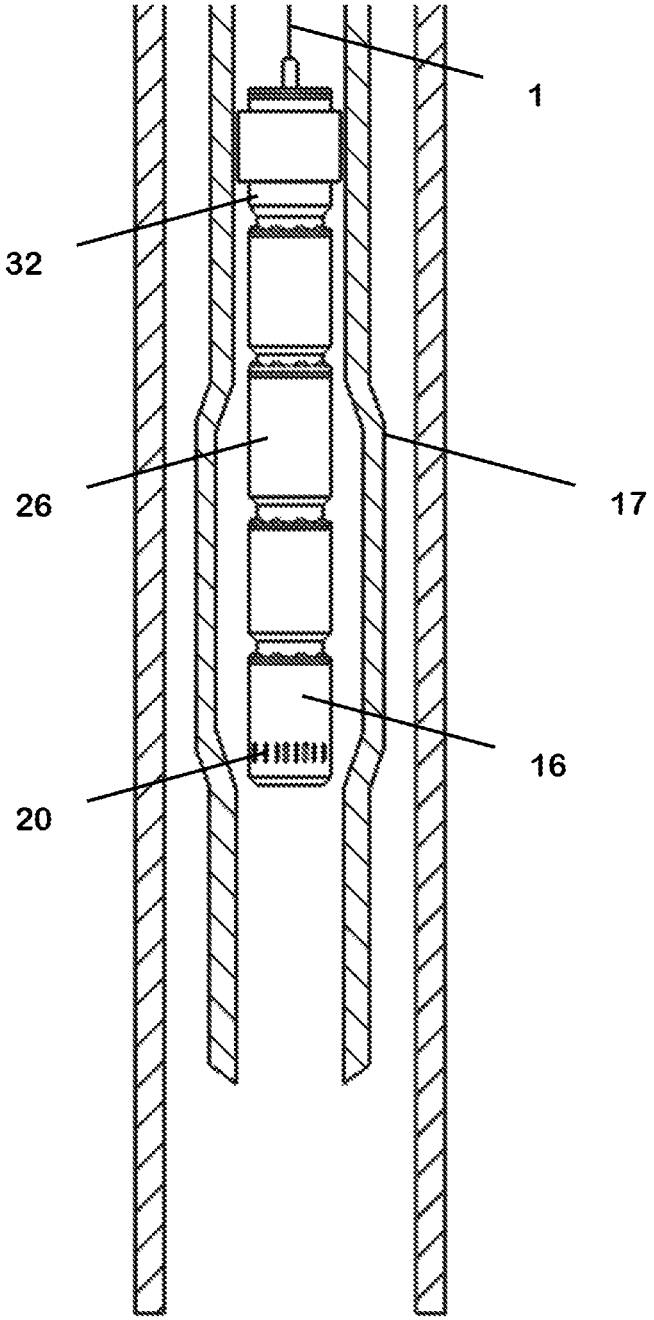
FIG. 2A shows a longitudinal section view of a well and an embodiment of a downhole pump system in accordance with at least some embodiments.

The ESP system is deployed within the production tubing 17 on a wireline 23, or on a cable if the system is cable deployed (see e.g., FIG. 2A). As the ESP system is lowered within the production tube, the ESP system is oriented and aligned as a plug arm 25 from the wet connector assembly 35 extends from the electric submersible pump string to project through an opening in the production tubing 17 and engage with the connector for the power cable 1. The wet connect assembly 35 (also referred to as power connection assembly 35 or power module 35) and the connector for the power cable 1 transmitting electrical energy from a surface power supply may mate using a known mechanism such as that described in UK patent GB2403 490, which is incorporated by reference herein.

Once the plug arm 25 of wet connect assembly 35 has engaged with the power cable 1 and the ESP system is supplied with power, the motor modules 26 may be activated to drive the pump modules 16 such that well fluid is drawn through the inlet ports 20 over the outside of the sensor housing 32 and the motor modules 26, into the pump inlet 20 and through pump modules 16 and then out through the pump outlet and up through the production tubing to the surface.

Referring now to FIG. 2A, a cable deployed or coil tubing deployed ESP system is shown. In certain ESP configurations deployed by cable or in coil tubing, power cable 1 is used to lower the ESP system into the well. In this configuration power cable 1 connects to motor 26 at the top of motor 26, or upstream side of the well, so that ESP gauge 32 is positioned above motor 26 and motor 26 is arranged above pump 16. This configuration makes the desired system layout arrange in a manner such that connector leads 5 from power cable 1 are routed through ESP gauge 32 in order to reach motor 26. In either of the ESP system arrangements shown in FIGS. 2 and 2A, the connector leads 5 from power cable 1 may be passed through the ESP gauge 32 in route to motor 26.

Figure 3:
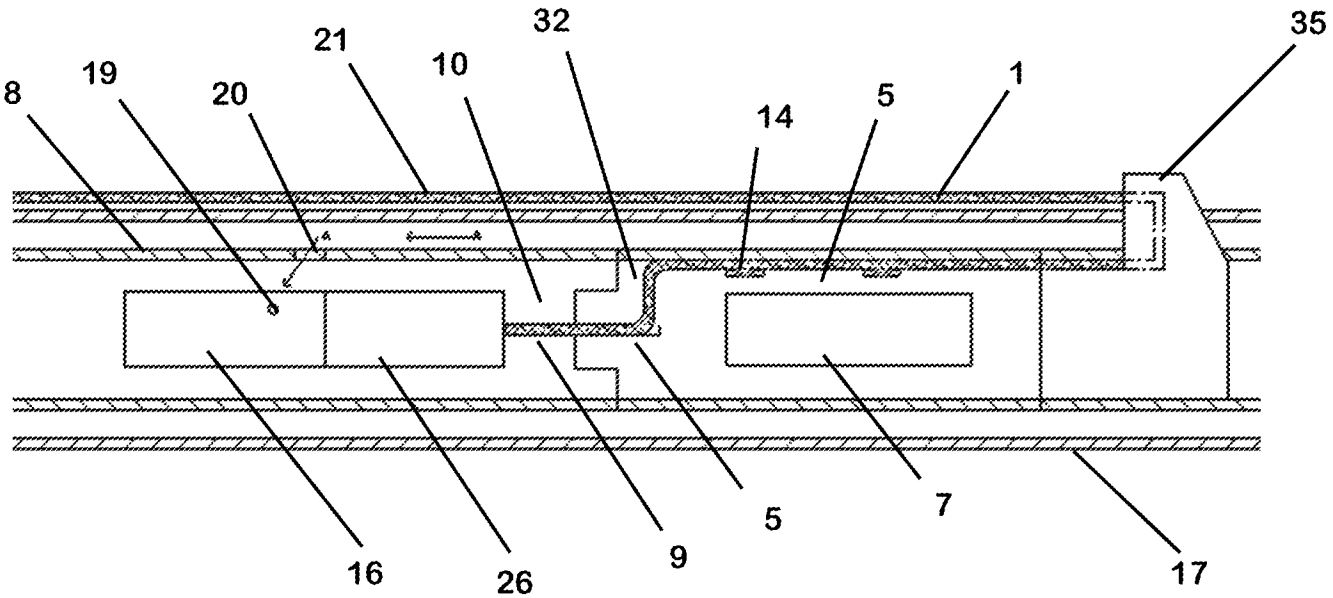
FIG. 3 shows an enlarged schematic longitudinal section view of the sensor and power connection portions of the downhole pump system of FIG. 2 in accordance with at least some embodiments.
Figure 4:
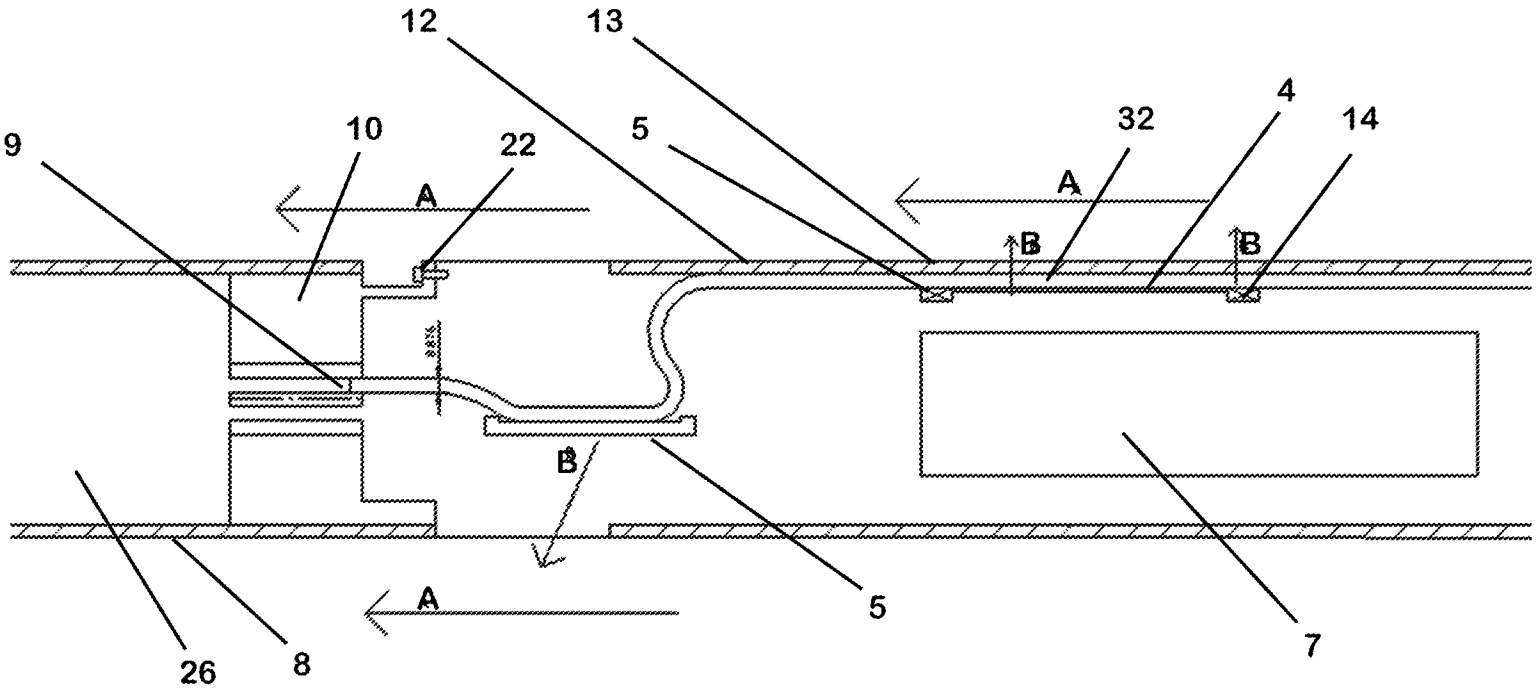
FIG. 4 shows a further enlarged longitudinal section view of the sensor portion of the downhole pump system of FIG. 2 in accordance with at least some embodiments.

Referring now to FIGS. 3 and 4, arrangements of the ESP gauge 32 and power module 35 according to certain embodiments are shown in more detail. A power module assembly 35 includes complimentary sets of plug and socket mating parts, one set connected to the power cable 1 arranged along the production tubing 17, and the other at the remote end of the ESP string and including plug arm 25. The ESP mating part of the power module 35 (i.e., plug arm 25) is located adjacent to the ESP gauge 32. In this arrangement (relating to the configuration illustrated by FIG. 2), ESP gauge 32 is located between the ESP system components (i.e., pump 16 and motor 26) and the power connection assembly 35. As a result of this configuration, the connector leads 5 electrically coupled to power line 1 from the power module 35 to the motor 26 passes through ESP gauge 32.

The ESP gauge 32 includes an internal surface 12, external surface 13, and a pathway for the connector leads 5 of ESP power line 1 to enable the connection of the surface electrical power supply to the ESP motor 26. Sensor 7 (and associated electronics) and a wire tray 4 are located within ESP gauge 32, as shown in FIG. 4. The connector leads 5 of power line 1 are located between the internal surface 12 and the wire tray 4 such that the connector leads 5 of power line 1 contact wire tray 4, and heat tray 4 is in direct contact with the internal surface 12 by support 14. Sensor 7 is located within ESP gauge 32, and may include a thermistor or thermocouple to measure fluid temperature, and may further include a flow sensor or pressure sensor to measure additional fluid properties in the vicinity of the motor. Sensor 7 may further include a gyroscope or an accelerometer to measure additional properties in the area of the motor.

Positioning ESP gauge 32 and sensor 7 directly below the motor advantageously allows for the measurement of the temperature, pressure, vibration and other properties of the motor, as well as fluid properties of the well immediately before fluid uptake by the pump 16. This configuration is in contrast to placing the sensor 7 downstream of the power module 35 and further away from the motor 26, as in conventional systems, which increases the complication of taking measurements indicative of the condition of the motor 26 and of conditions surrounding the motor and pump inlet. Information indicative of wellbore fluid prior to entering the pump can be more effectively measured and monitored, and thereby used to more efficiently control the motor 26 and pump 16 operation and prevent damage to the motor 26 and or pump 16.

Additionally, locating the ESP gauge 32 directly adjacent to motor 26 allows for sensor and other electrical connections to be made without the need for routing electrical and sensor leads through capillary tubing. Direct electrical connection can be made between the sensor 7 and the motor 26 to measure the motor temperature and vibration without the need to bypass the wet connect portion of the string as is the case with conventional systems.

The ESP gauge 32 contains sensor 7, which may in certain embodiments include at least one of a temperature, vibration and pressure sensor, and which is protected from the heat and electrical noise generated by the power line 1. The location of the sensor 7 in a more protected configuration is made possible by this particular arrangement, including the configuration of ESP gauge 32 utilizing wire tray 4, and allows the sensor 7 to be located adjacent to the motor 26, as seen in FIG. 3, or directly below the motor 26 as seen in FIG. 2. FIG. 4 depicts an enlarged view of the ESP gauge 32, shown fixedly connected to the motor housing 8 by bolts 22. The motor 26 shown in FIG. 2 is used to provide power for the pump 16, which pumps fluid from the formation up to the surface, in the direction of arrow A. In the functional arrangement of this downhole system, the connector leads 5 of power line 1 connecting the motor 26 to the electrical power supply located on the surface passes alongside the internal surface 12 of the ESP gauge 32. Power line 1 connecting the motor 26 with the electrical power supply located on the surface typically carries a significant current load to power the motor 26, which generates substantial heat and electrical noise in close proximity to the sensor 7. The wire tray 4 is designed to dissipate that heat away from the sensor 7 by being highly conductive and conducting the heat preferentially away from the sensor 7 rather than toward it. In addition to providing a heat dissipation function, wire tray 4 may also provide shielding from electrical noise that can cause communication difficulties for sensor 7, and in some instances lead to premature component failure. In particular, when construction from gold plated aluminum wire tray 4 may be configured to act as an electromagnetic shield around the connector leads 5 of power line 1, and may serve to significantly attenuate electrical noise from power line 1.

Referring still to FIG. 4, the pump 16 pumps wellbore fluid from the formation and draws the well fluids over the outside of the external surface 13 of ESP gauge 32 as shown by arrow A. The wire tray 4 is urged toward the internal surface 12 of ESP gauge 32 to provide direct contact between the wire tray 4 and the sensor housing 32. In this embodiment fluid flow in the direction of arrow A contacts the external surface 13 of the ESP gauge 32 and provides a heat sink for the heat generated by the power line during use, wherein the heat is transferred from the power line 1 to the wire tray 4. Preferably, direct contact of wire tray 4 with ESP gauge 32 positions the components such that external surface 13 is in good thermal contact with the fluid flowing past the sensor housing in order to effectively remove heat from within ESP gauge 32 from power line 1 by way of direct heat transfer through the sensor housing 32. This arrangement allows for the transfer of heat generated by the power line 1 preferably away from the sensor 7 disposed within ESP gauge 32 and through the sensor housing wall into the surrounding fluids. More particularly, the direct contact between the wire tray 4 and the internal surface 12 provides for the transfer of heat in the direction of arrow B and into the well fluids drawn over the surface of sensor housing 32 by the operation of pump 16. In this embodiment, the wire tray 4 is made of beryllium copper, a highly thermally conductive material, but other highly thermally conductive materials (i.e., gold plated aluminum) may be equivalently used.

Referring still to FIG. 4, in this embodiment there is a further heat dissipating means in the form of a heat dissipating tray 5. In this embodiment, a portion of the power line 1 is routed away from the internal surface 12 of the ESP gauge 32 to form a connection with the connecting socket 9 on the ESP motor housing 8 located in the center of the motor end cap 10. The heat dissipating tray 5 supports the cable in this intermediate position and acts as another heat sink for the power line 1. Heat dissipating tray 5 may be constructed of a copper alloy, although other thermally conductive materials could equivalently be used. The heat dissipating tray 5 conducts heat generated by that part of the power line 1 that typically includes a loop of cable slack before the connecting socket 9 to allow for sufficient play in the cable during fitting. The heat dissipating tray 5 conducts the heat away from this portion of the cable down to the internal surface 12 and away from the sensor 7. Arrow B again shows the direction of flow of this heat.

Figure 5:
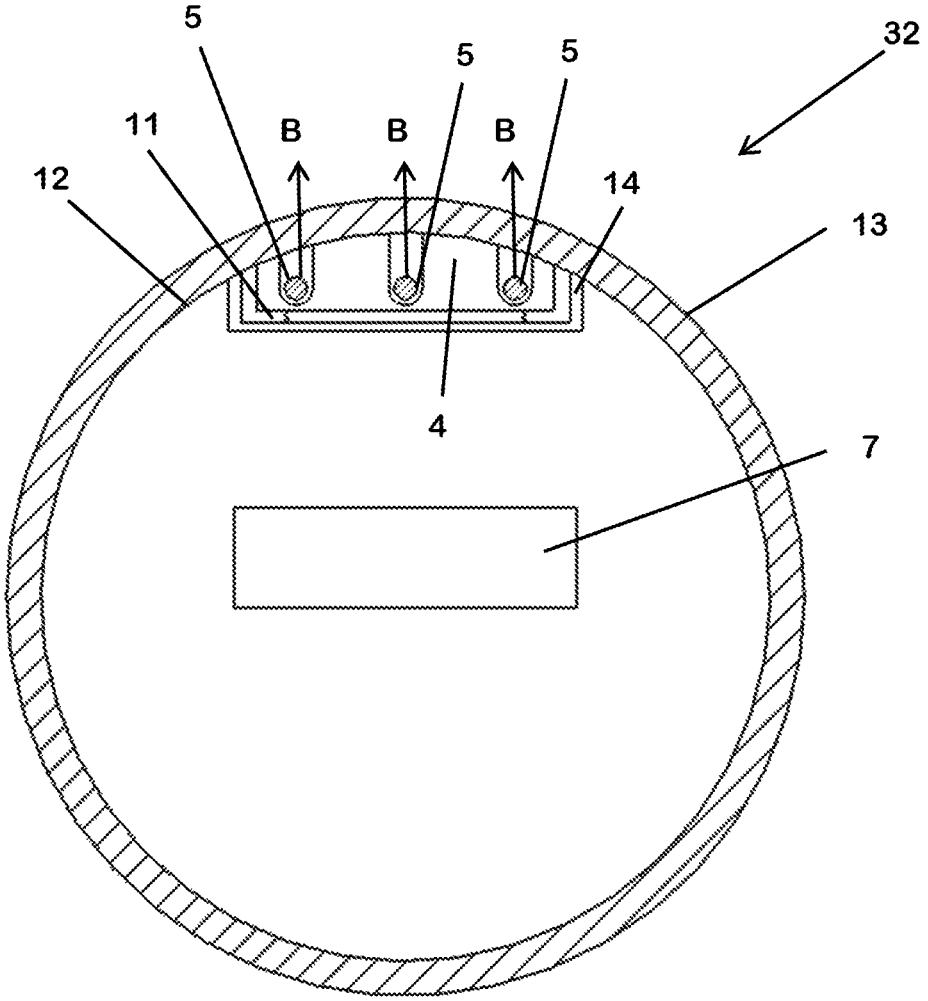
FIG. 5 shows an enlarged cross section view of the sensor portion of the downhole pump system of FIG. 2 in accordance with at least some embodiments.

As can be seen in FIGS. 4 and 5, given the proximity of the sensor 7 to the power line 1, the wire tray 4 provides a conduit for heat to be transferred away from the sensor 7 in the direction of arrow B. FIG. 5 also shows the movement of heat with the direction of arrow B out of the power line 1 and into the fluid surrounding the external surface 13 of sensor housing 32. This efficient heat dissipation and electromagnetic noise shielding from the power line 1 enables a given size of the power line 1 to carry more current without overheating sensor housing 32 and negatively affecting sensor 7, or alternatively a narrower size of conductor may be used to carry the same current. Furthermore, as the load on pump 16 and motor 26 increases, a higher current is required to power those devices which can result in the generation of more heat and electromagnetic noise in the power line 1. The inventors have discovered that the occurrence of simultaneously increasing the current delivered by the power line in order to create a greater flow rate of fluid pumped alongside the external surface 13 increases the rate of cooling of the sensor housing, thereby beneficially providing a self-balancing temperature control.

Figure 6:
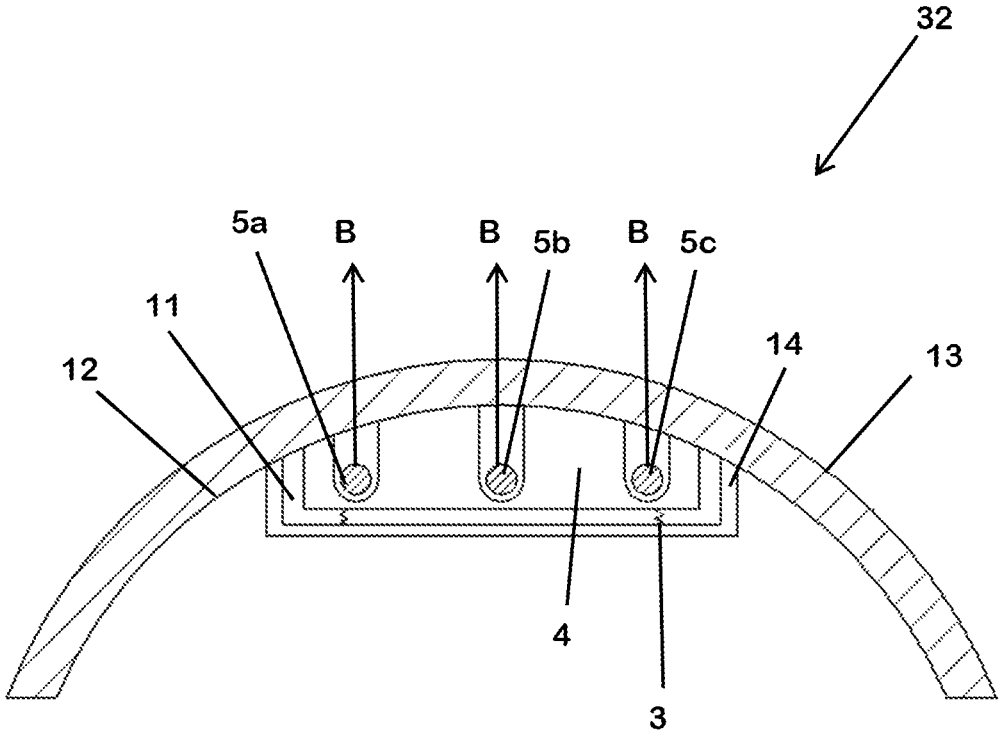
FIG. 6 shows a further enlarged cross section view of the heat dissipation system of the sensor portion of FIG. 4 in accordance with at least some embodiments.

The wire tray 4 is urged against the internal surface 12 by means of a resilient member 3, as shown in FIG. 6. The resilient member 3 is a spring bearing against a fixed support 11. Referring again to FIGS. 4, 5 and 6, the wire tray 4 is pressed against the internal surface 12 of the ESP gauge 32 by a number of supports 14, and in this embodiment these are distributed along the length of the wire tray 4. The support 14 includes a fixed support 11 and resilient members 3 (or springs 3), as shown in FIG. 6, to ensure a secure contact with the internal surface 12 of the sensor housing 32 while allowing the metal to expand and contract with expected significant changes in temperature. In certain additional embodiments, wire tray 4 may be directed secured to ESP gauge 32 by way of threaded connectors, rivets, or the like.

FIG. 6 shows a further enlarged cross section of the heat dissipating tray 4 with the power line 1 passing through, in this embodiment the power line 1 is shown separated into a typical three phase supply with three connector leads or conductors 5*a*, 5*b*, and 5*c*. Each conductor is in direct contact with the wire tray 4 and the internal surface 12 to ensure maximum heat transfer from power line 1 through ESP gauge 32. Each conductor will typically be made of a copper core surrounded by an electrically insulating and heat resistant, but somewhat heat conductive sheath material. The springs 3 elastically retain the heat dissipating tray 4 in direct contact with the internal surface 12 of the ESP gauge 32, and are held in place by the fixed support 11.

While preferred embodiments of this disclosure have been shown and described, modifications thereof can be made by one skilled in the art without departing from the scope or teaching herein. The embodiments described herein are exemplary only and are not limiting. Because many varying and different embodiments may be made within the scope of the present inventive concept, including equivalent structures, materials, or methods hereafter though of, and because many modifications may be made in the embodiments herein detailed in accordance with the descriptive requirements of the law, it is to be understood that the details herein are to be interpreted as illustrative and not in a limiting sense.

What is claimed is:

1. A pumping system for pumping well fluid through a production tube in a borehole, comprising:

an electric submersible pump assembly including a motor and a pump, the pump having an inlet and an outlet;

wherein the motor is electrically connected to a power supply by a power line;

a sensor housing disposed adjacent to the motor, wherein the sensor housing comprises an internal surface and an external surface, and a sensor disposed in the sensor housing;

a wire tray disposed within the sensor housing and in direct contact with the internal surface, wherein the wire tray engages a portion of the power line, and wherein the external surface is positioned in contact with a fluid flow in the production tube induced by the pump, wherein the wire tray is spaced away from the sensor and shields the sensor from the power line.

2. The pumping system of claim 1, wherein the sensor housing is disposed between the motor and a power connection assembly.

3. The pumping system of claim 2, wherein the power line comprises at least one connector lead connected between the power connection assembly and the motor.

4. The pumping system of claim 1, wherein the wire tray further comprises a support member and a resilient member.

5. A downhole powered device system comprising:

a powered device;

a power line connectable to a power supply;

a sensor system arranged in a sensor housing, whereby the sensor housing is located between the powered device and the power supply, and the power line, passes through the sensor housing to the powered device, wherein the sensor housing comprises an internal surface and an external surface, wherein the sensor housing further comprises a wire tray disposed adjacent to the internal surface, and wherein the wire tray engages a portion of the power line and transfers heat from the power line to the internal surface.

6. The downhole powered device system of claim 5, wherein the powered device comprises an electric submersible pump assembly.

7. The downhole powered device system of claim 5, wherein heat from the power line is dissipated away from the sensor system.

8. The downhole powered device system of claim 5, wherein the powered device causes a fluid to be drawn across the external surface.

9. The downhole powered device system of claim 5, wherein the sensor system is electrically connected to the powered device.

10. The downhole powered device system of claim 5, wherein the sensor system comprises a thermistor or thermocouple.

11. The downhole powered device system of claim 5 wherein the wire tray remains in contact with the internal surface of the sensor housing by a resilient member.

12. The downhole powered device system of claim 5 wherein the wire tray remains in direct contact with the internal surface of the sensor housing through direct attachment thereto.

13. The downhole powered device system of claim 5 wherein the wire tray is made of metallic or other thermally conductive material.

14. The downhole powered device system of claim 5 wherein the wire tray further comprises a length, and an outer surface in direct contact along its length with the internal surface of the sensor housing.

15. A method for monitoring downhole properties comprising:

providing a sensor system arranged in a sensor housing having an internal surface and an external surface, whereby the sensor housing is located between a powered device and a power connector, and a power line passes through the sensor housing to the powered device;

providing a wire tray disposed within the sensor housing and in direct contact with the internal surface, wherein the wire tray engages a portion of the power line, and wherein the external surface is positioned in contact with a fluid flow in the production tube induced by the pump, and wherein the wire tray is spaced away from the sensor and shields the sensor from the power line;

isolating the sensor system from a thermal effect or a noise effect generated by the power line, wherein the step of isolating from a thermal effect comprises a heat transfer from the power line through the wire tray and through a sensor housing wall to a fluid drawn over a sensor housing external surface, and wherein the step of isolating from a noise effect comprises shielding the portion of the power line with the wire tray; and monitoring a signal generated by the sensor system that is indicative of the downhole properties in the vicinity of the powered device.

16. The method of claim 15, wherein the signal is indicative of a wellbore fluid temperature.

17. The method of claim 15, wherein the signal is indicative of a wellbore fluid pressure.

18. The method of claim 15, wherein the signal is indicative of a powered device temperature.

19. The method of claim 15, wherein the rate of the heat transfer increases responsive to an increase in current through the power line.

20. The method of claim 15, further comprising shielding the sensor system from an electromagnetic interference generated by the power line.

21. A downhole powered device system comprising:

a powered device;

a power line connectable to a power supply;

a sensor system arranged in a sensor housing having an internal surface and an external surface, whereby the sensor housing is located between the powered device and the power supply, and the power line passes through the sensor housing to the powered device;

one or more sensors and associated electronics located within the sensor housing;

a wire tray disposed adjacent to the internal surface, wherein the wire tray engages and substantially surrounds a substantial portion of the power line within the sensor housing, shielding the surrounding one or more sensors and associated electronics from an electrical noise generated by the power line.

22. The pumping system of claim 21, wherein the sensor housing is disposed between the motor and a power connection assembly.

23. The pumping system of claim 22, wherein the power line comprises at least one connector lead connected between the power connection assembly and the motor.

24. The pumping system of claim 21, wherein the wire tray further comprises a support member and a resilient member.

25. The downhole powered device system of claim 21, wherein the powered device causes a fluid to be drawn across the external surface.

26. The downhole powered device system of claim 21, wherein the sensor system is electrically connected to the powered device.

27. The downhole powered device system of claim 21 wherein the wire tray remains in contact with the internal surface of the sensor housing by a resilient member.

28. The downhole powered device system of claim 21 wherein the wire tray remains in direct contact with the internal surface of the sensor housing through direct attachment thereto.

29. The downhole powered device system of claim 21 wherein the wire tray is made of metallic other thermally conductive material.

30. The downhole powered device system of claim 21 wherein the wire tray further comprises a length, and an outer surface in direct contact along its length with the internal surface of the sensor housing.

* * * * *